United States Patent [19]

Fawcett

[11] Patent Number: 4,798,361

[45] Date of Patent: Jan. 17, 1989

[54] MULTI-SWIVEL CHAIR

[76] Inventor: William H. Fawcett, 3730 Southview Dr. #437, San Diego, Calif. 92117

[21] Appl. No.: 112,881

[22] Filed: Oct. 27, 1987

[51] Int. Cl.[4] ..... F16M 13/00

[52] U.S. Cl. ..... 248/415; 248/188.4; 297/349

[58] Field of Search ..... 248/415, 186.1, 349, 248/425, 416, 188.2, 188.4, 371, 397, 398, 514; 297/349, 345, 241

[56] References Cited

U.S. PATENT DOCUMENTS

| | | | |
|---|---|---|---|
| 1,484,229 | 9/1924 | Miles | 248/416 |
| 2,586,120 | 8/1948 | Templeton | 155/51 |
| 2,650,647 | 9/1950 | MacKnight | 155/81 |
| 2,660,833 | 12/1953 | Weber | 248/514 X |
| 2,803,510 | 8/1957 | Carbary | 248/188.2 X |
| 3,133,765 | 5/1964 | Kramer | 297/445 |
| 3,186,761 | 6/1965 | Propst | 248/425 X |
| 3,542,424 | 11/1970 | Bingley | 297/349 |
| 3,727,873 | 7/1973 | Hill | 248/418 |
| 3,750,989 | 8/1973 | Bergeson | 248/188.4 X |
| 3,964,713 | 6/1976 | Joslyn | 297/349 X |
| 4,023,760 | 12/1975 | Robinson | 248/188.2 |
| 4,181,281 | 12/1978 | Kosak | 248/416 |
| 4,316,634 | 2/1982 | Roesler | 248/416 X |
| 4,368,869 | 1/1983 | Gelvezon | 248/188.4 X |
| 4,620,686 | 11/1986 | Conant | 248/415 |

FOREIGN PATENT DOCUMENTS

| | | | |
|---|---|---|---|
| 768017 | 9/1967 | Canada | 248/188.2 |
| 2416154 | 10/1975 | Fed. Rep. of Germany | 248/188.4 |

*Primary Examiner*—J. Franklin Foss
*Assistant Examiner*—Robert A. Olson
*Attorney, Agent, or Firm*—Lewis E. Massie

[57] ABSTRACT

A swivel chair of the type embodying a circular support base with articulated arms axially supported at the center of the base. The chair is capable of rotating 360 degrees horizontally around the axis. The chair base includes a tilting plate supporting the vertical axle. The amount of tilt is adjustable by an allen bolt in the base allowing exact vertical alignment of the axle. The chair supporting spindle receptacle is adjustable to accept spindle arrangements through a wide range of diameters and lengths.

3 Claims, 2 Drawing Sheets

MULTI-SWIVEL CHAIR

BACKGROUND OF THE INVENTION

1. Field of the Invention

Multi-swivel chairs providing access to work stations within a 360 degree circular range have been proposed for specialized applications for musicians, sport fishermen, machine operators, dentists, barbers and more recently computer work station operators. The basic design of the multi-swivel chairs include a support base, usually circular, the center of the base having a vertical axle supporting a first support arm. The first support arm includes a pivot supporting a second support arm which includes a support fixture for a chair body.

The improvements provided by the present invention include means for compensating the base for unlevel floors and means for using the wide variety of commercially available chair seats.

2. Description of the Prior Art

Reference is made to U.S. Pat. No. 4,023,760 and U.S. Pat. No. 4,181,281 disclosing improvements in the basic multiswivel chair as described in U.S. Pat. No. 1,484,229. The improvement described in U.S. Pat. No. 4,023,760 relates to means compensating for mounting the chair on an uneven floor. U.S. Pat. No. 4,181,281 relates to means for adjusting the degree of friction with respect to the floating action of the chair.

SUMMARY OF THE INVENTION

A first objective of the present invention is to provide a less costly support structure having a simplified means for adjusting the base for installation on uneven floors.

The chair base provides a circular pad of metal or composite material having a vertical axle at the center supporting a first horizontal chair support arm. A second horizontal chair support arm is mounted on the first arm and is rotatable around the outside end of the first support arm.

The vertical axle is supported in a bearing shaft fastened to a hinged base plate. The base plate is rotatable around a horizontal hinge shaft traversing a rectangular frame enclosing the base plate. The rectangular frame is fastened to the bottom of the chair pad. The base plate hinge shaft is supported at one end and is supported by an allen head bolt at the other end. The bearing shaft is centered between the two ends. A horizontal flat plate is fastened to the frame above the allen head bolt and includes a hole to accommodate the allen head bolt. Rotating the allen bolt rotates the base plate to provide exact vertical orientation of the bearing shaft and the vertical axle even though the support base is resting on a surface, or floor, that is not perfectly level. A simple and easily accomplished procedure.

A second objective of the invention is to supply a multiswivel chair base that will readily accept the many chairs mass produced for the chair market. Many production chairs utilize a gas cylinder lift mechanism to raise and lower the chairs while others use a mechanical device.

It is necessary to position the bottom of the gas cylinder or mechanical system as close to the floor as possible in order to meet the ergonomic criteria for adjusting chair height. The present invention provides a support for a gas cylinder or mechanical spindle that will accommodate a wide selection of systems differing in diameters and lengths. The variance in diameters are fitted by using support sleeves of different thickness and the variance in lengths accommodated by support sleeves of various lengths. The upper support arm must be longer than the lower support arm to provide rotational clearance for the lift structure.

DESCRIPTION OF THE PREFERRED EMBODIMENT

Figure 1:
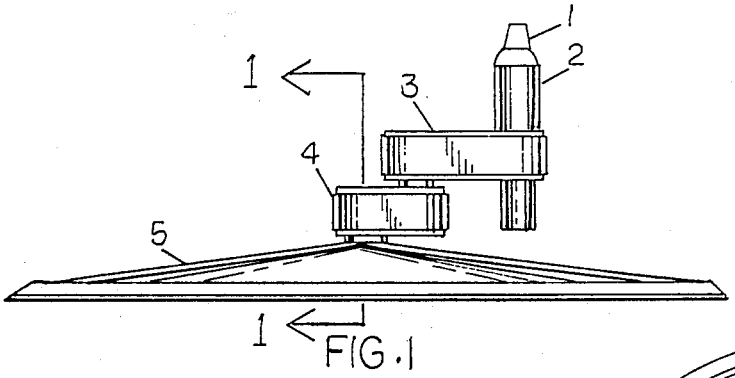
FIG. 1 is a side elevation of the multi-swivel chair.

Referring to FIG. 1 the circular floor pad 5 is shown, made of metal or composite material and having a first chair support arm 4 pivoted around the center of pad 5. A second chair support arm 3 is pivoted around the out side end of arm 4. A chair support spindle 1 is coaxially mounted in a spindle support tube 2.

Figure 3:
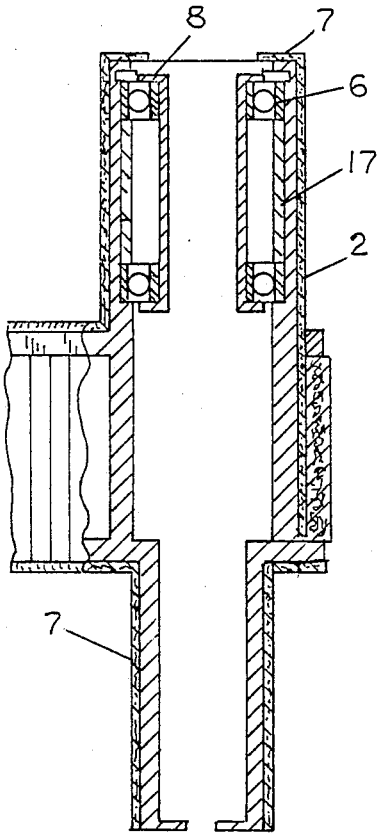
FIG. 3 is a sectional view of the chair support spindle.

Referring to FIG. 3 the spindle support tube 2 is shown with spindle bearing 6 and interchangeable sleeve 8, vertical spacer tube 17 and decorative external covering 7.

Figure 4:
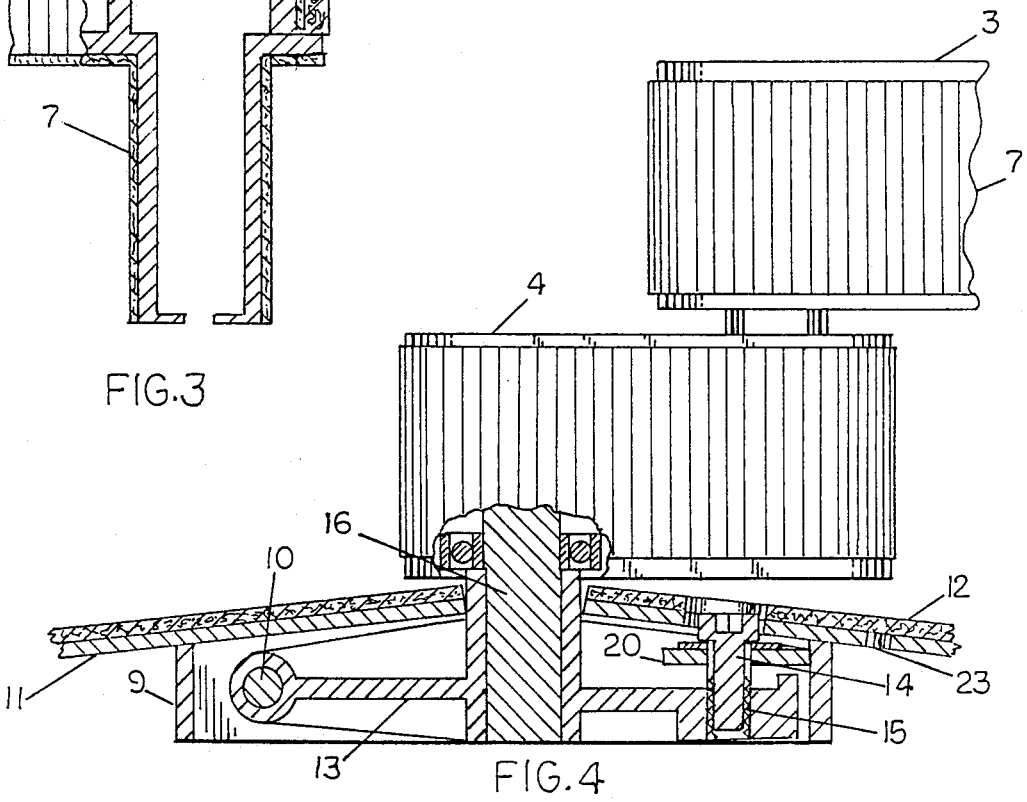
FIG. 4 is a sectional view through 1—1 of FIG. 1 showing chair base leveling mechanism.
Figure 6:
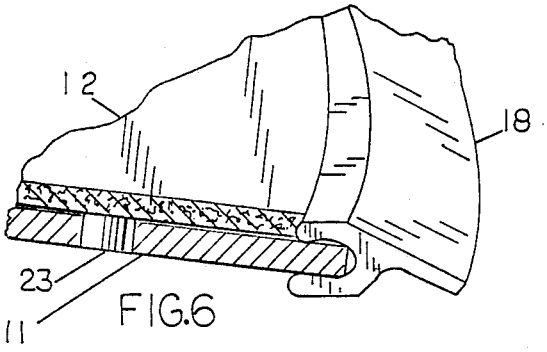
FIG. 6 is detail of the outer periphery of the base.
Figure 7:
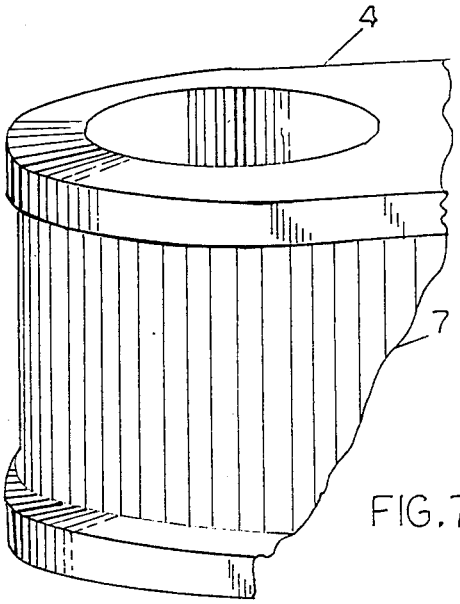
FIG. 7 is a detailed view of chair base support arm decorative covering.
Figure 5:
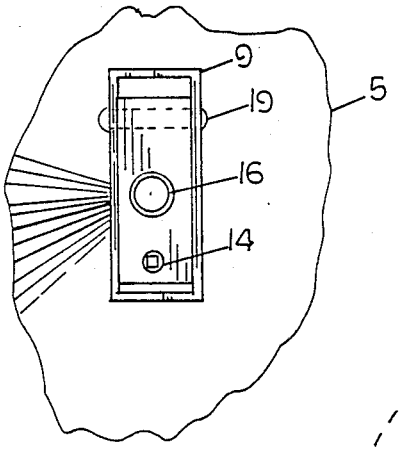
FIG. 5 is a bottom view of leveling mechanism.
Figure 8:
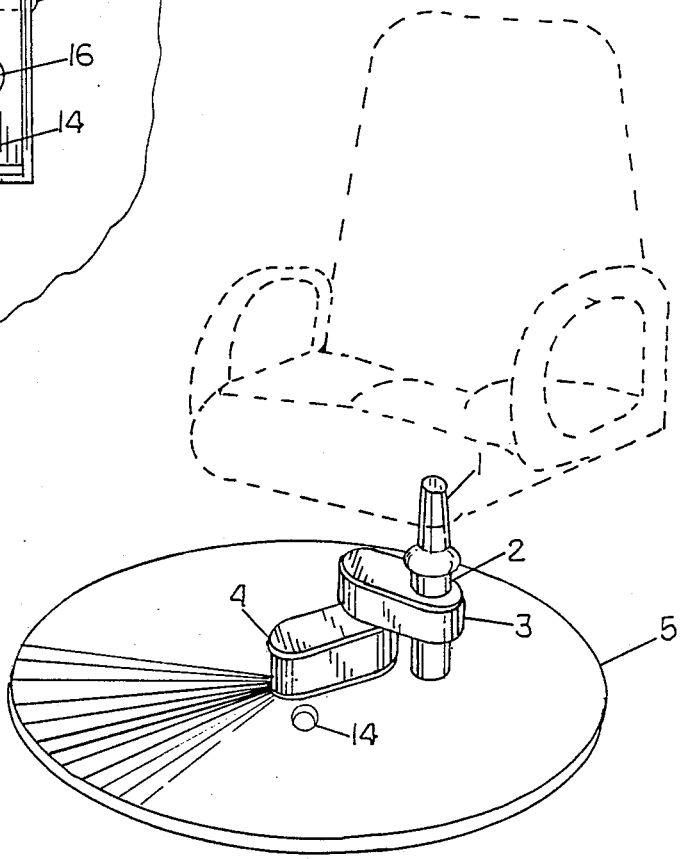
FIG. 8 is a top perspective view of multi-swivel chair base.

Referring to FIG. 4 support arm 4 is shown rotatable around vertical axle 16 which is rotatable around bearing shaft base plate 13. Base plate 13 is rotatable in the vertical plane defined by bearing shaft 10 transversely between sides of rectangular frame 9. Allen bolt 14 through plate 20 engages threaded hole 15 in plate 13. Rotation of bolt 14 rotates plate 13 around shaft 10 to locate vertical axle 16.

Figure 2:
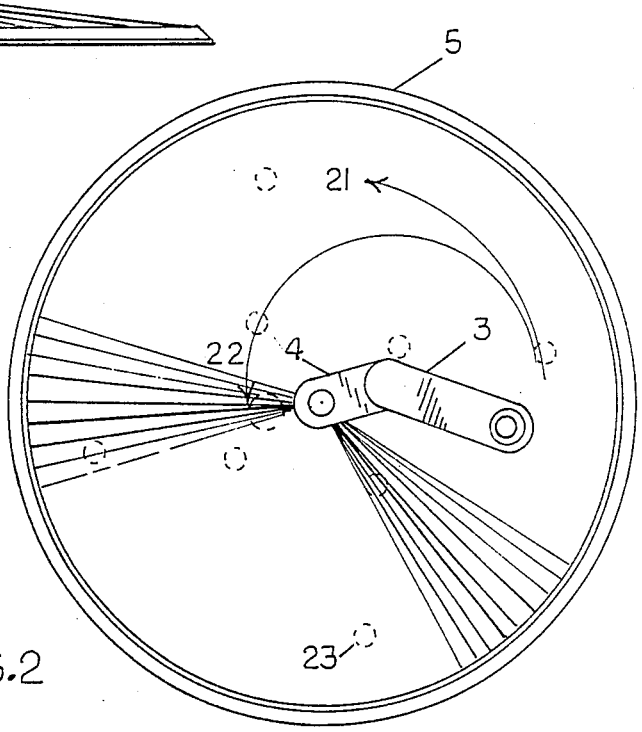
FIG. 2 is a plan view of the multi-swivel chair.

Referring to FIG. 2 support arm 3 must have a greater length than arm 4 to provide rotational clearance for 360 degree rotation as shown by arrows 21 and 22. Ventilating holes 23 are provided in pad 5 beneath carpeting 12.

If the pad 5 is placed upon a floor that is not level the support arm 4 and chair will rotate to the low side of the floor. The support pad 5 is then rotated until the access hole for bolt 14 is directly beneath the arm 4. An allen wrench engaging bolt 14 is used to rotate base 13 to align shaft 16 to the exact vertical position.

I claim:

1. An articulated multi-swivel-chair rotatable 360 degrees horizontally having a vertical axis centrally mounted on a circular floor pad, the chair carried by jointed arms rotating around the axis wherein the improvement comprises a. the central axle being a vertical axle rotating in a sleeve bearing;

b. the sleeve bearing mounted upon a horizontal base plate;

c. a horizontal bearing shaft through one end of the base plate;

d. a vertical threaded hole on a longitudinal center line at the other end of the base plate;

e. a horizontal rectangular frame centrally fastened to the bottom of the circular floor pad;

f. the rectangular frame enclosing the base plate;

g. a bearing rod transversely through the walls of the rectangular frame engaging the horizontal shaft in the base plate;

h. a horizontal plate fastened to the rectangular frame above the vertical threaded hole in the base plate;

i. a clearance hole in the horizontal plate aligned with the threaded hole in the base plate; and, j. an allen bolt through the clearance hole in the horizontal plate engaging the threaded hole in the base plate.

2. A multi-swivel chair as described in claim 1 wherein the improvement further comprises a. a chair support arm having a vertical, cylindrical, support tube on the outer end of the arm;

b. the support tube having ball bearing rings on the inside circumference;

c. the ball bearing rings separated vertically by replaceable spacer sleeves;

d. the inside diameter of the support tube determined by accessory sleeves of various wall thickness.

3. A multi-swivel chair as described in claim 1 wherein the improvement further comprises a. the outside surfaces of the circular floor pad covered with replacable, interchangeable covering materials in color or texture;

b. ventilating orifices in the circular floor pad beneath the covering materials; and, c. outside surfaces of said jointed chair support arms covered with replaceable, interchangeable covering materials.

* * * * *